US011214845B2

(12) United States Patent
Park et al.

(10) Patent No.: US 11,214,845 B2
(45) Date of Patent: Jan. 4, 2022

(54) STEEL SHEET FOR TOOL AND MANUFACTURING METHOD THEREFOR

(71) Applicant: POSCO, Pohang-si (KR)

(72) Inventors: Kyong Su Park, Pohang-si (KR); Jae Hoon Jang, Pohang-si (KR)

(73) Assignee: POSCO, Pohang-si (KR)

( * ) Notice: Subject to any disclaimer, the term of this patent is extended or adjusted under 35 U.S.C. 154(b) by 558 days.

(21) Appl. No.: 16/066,648

(22) PCT Filed: Jun. 29, 2016

(86) PCT No.: PCT/KR2016/006963
§ 371 (c)(1),
(2) Date: Jun. 27, 2018

(87) PCT Pub. No.: WO2017/115958
PCT Pub. Date: Jul. 6, 2017

(65) Prior Publication Data

US 2019/0017133 A1 Jan. 17, 2019

(30) Foreign Application Priority Data

Dec. 28, 2015 (KR) ..... 10-2015-0187113

(51) Int. Cl.
*C21D 8/02* (2006.01)
*C22C 38/02* (2006.01)
(Continued)

(52) U.S. Cl.
CPC ..... *C21D 8/0205* (2013.01); *C21D 8/0226* (2013.01); *C22C 38/02* (2013.01);
(Continued)

(58) Field of Classification Search
CPC ..... C21D 2211/002; C21D 2211/005; C21D 2211/009
See application file for complete search history.

(56) References Cited

U.S. PATENT DOCUMENTS 6,149,743 A * 11/2000 Lund ..... C21D 1/20 148/579
2012/0006451 A1 1/2012 Abe et al.
(Continued)

FOREIGN PATENT DOCUMENTS

CN 101098979 A 1/2008
GB 2019436 A * 10/1979 ..... C22C 38/18
(Continued)

OTHER PUBLICATIONS

Extended European Search Report dated Sep. 27, 2018 issued in Korean Patent Application No. 16881911.8.
(Continued)

*Primary Examiner* — Anthony J Zimmer
*Assistant Examiner* — Sean P. O'Keefe
(74) *Attorney, Agent, or Firm* — Morgan, Lewis & Bockius LLP

(57) ABSTRACT

The invention relates to a steel sheet for tool, and method for manufacturing thereof. An embodiment of the present invention is a steel sheet for a tool comprising 0.4 to 0.6 wt % of C, 0.05 to 0.5 wt % of Si, 0.1 to 1.5 wt % of Mn, 0.05 to 0.5 wt % of V, 0.1 to 2.0 wt % of at least of one or two components selected from the group comprising Ni, Cr, Mo, and combinations thereof, and the balance of Fe and inevitable impurities, with respect to 100 wt % of the total steel sheet, and provides a steel sheet for a tool of which the deviation of Rockwell hardness by the position in the width direction is within 5 HRC, and the ratio of those having a wave height in the longitudinal direction within 20 cm is 90% or more with respect to the wave height per 1 m of the steel sheet comprising the central portion in the longitudinal direction of the steel sheet for a tool.

8 Claims, 3 Drawing Sheets

(51) Int. Cl.
*C22C 38/44* (2006.01)
*C22C 38/46* (2006.01)
*C22C 38/04* (2006.01)

(52) U.S. Cl.
CPC ..... *C22C 38/04* (2013.01); *C22C 38/44* (2013.01); *C22C 38/46* (2013.01); *C21D 2211/002* (2013.01); *C21D 2211/005* (2013.01); *C21D 2211/009* (2013.01)

(56) References Cited

U.S. PATENT DOCUMENTS

| | | | |
|---|---|---|---|
| 2013/0180631 | A1 | 7/2013 | Park et al. |
| 2014/0212660 | A1 | 7/2014 | Takeda et al. |

FOREIGN PATENT DOCUMENTS

| | | | |
|---|---|---|---|
| JP | S5534659 | A | 3/1980 |
| JP | S57-47828 | A | 3/1982 |
| JP | H07-179936 | A | 7/1995 |
| JP | H11-229031 | A | 8/1999 |
| JP | 2002-155338 | A | 5/2002 |
| JP | 2005-171303 | A | 6/2005 |
| JP | 2005-213566 | A | 8/2005 |
| JP | 2010-216008 | A | 9/2010 |
| JP | 2011-52321 | A | 3/2011 |
| JP | 2011-179042 | A | 9/2011 |
| JP | 2013-136820 | A | 7/2013 |
| JP | 2013-540896 | A | 11/2013 |
| JP | 5680461 | B2 | 3/2015 |
| JP | 5744300 | B1 | 7/2015 |
| JP | 2015-190037 | A | 11/2015 |
| KR | 10-0497446 | B1 | 6/2005 |
| KR | 10-0722394 | B1 | 5/2007 |
| KR | 10-2010-0074828 | A | 7/2010 |
| KR | 10-1033752 | B1 | 5/2011 |
| KR | 10-2011-0098185 | A | 9/2011 |
| KR | 10-2013-0068082 | A | 6/2013 |
| KR | 10-2013-0106139 | A | 9/2013 |
| KR | 10-2013-0140205 | A | 12/2013 |
| KR | 10-2014-0014276 | A | 2/2014 |
| KR | 10-2014-0072245 | A | 6/2014 |
| KR | 10-2015-0030466 | A | 3/2015 |
| KR | 10-2015-0038426 | A | 4/2015 |

OTHER PUBLICATIONS

Written Opinion and International Search Report dated Sep. 12, 2016 issued in International Patent Application No. PCT/KR2016/0006963 (with English translation).

Office Action issued in Japanese Patent Application 2018-534162 dated Jul. 16, 2019, with English translation.

Chinese Office Action dated Jul. 9, 2019 issued in Chinese Patent Application No. 201680076902.0.

* cited by examiner

< Comparative Example >

< Example >

STEEL SHEET FOR TOOL AND MANUFACTURING METHOD THEREFOR

CROSS REFERENCE

This patent application is the U.S. National Phase under 35 U.S.C. § 371 of International Application No. PCT/KR2016/006963, filed on Jun. 29, 2016, which claims the benefit of Korean Patent Application No. 10-2015-0187113, filed on Dec. 28, 2015, the entire contents of each are hereby incorporated by reference.

TECHNICAL FIELD

An embodiment of the present invention relates to a steel sheet for a tool, and method for manufacturing thereof.

BACKGROUND ART

In order to achieve excellent strength and toughness after the final heat treatment, the following conventional technology are used for the high-carbon steel sheet for a tool.

As a representative example, in the patent documents 1 to 3, there are technologies of securing the strength and toughness of the final product after the final heat treatment by adjusting the content of Mn, Cr, Mo, W and V.

However, these hot-rolled products of high alloy are produced in electric furnaces until the present day, and most of them are products which have thick thickness, narrow width and small unit weight. This is because, when the thickness is thin and the width is wide, it is impossible to work in the subsequent cold rolling process due to heterogeneous shape. This is because, in the case of high alloy steel, the structure of the hot-rolled products generated according to the difference of the cooling rate by position greatly changes since the phase transformation speed is slow. Because of this, it has to be produced in small unit weight of which thickness is thick and width is narrow.

Accordingly, there is a growing need for the development of a hot-rolled coil which is thin and has wide width for the productivity improvement and the efficiency of cold rolling.

PRIOR ART DOCUMENT

Patent Document (Patent document 1) Japanese Patent Publication No. 5744300.

(Patent document 2) Japanese Patent Publication No. 5680461.

(Patent document 3) Korean Patent Registration No. 0497446.

DISCLOSURE

Technical Problem

An embodiment of the present invention is to provide a method of manufacturing steel sheet for a tool.

Technical Solution

A steel sheet for a tool according to an embodiment of the present invention comprising 0.4 to 0.6 wt % of C, 0.05 to 0.5 wt % of Si, 0.1 to 1.5 wt % of Mn, 0.05 to 0.5 wt % of V, 0.1 to 2.0 wt % of at least of one or two components selected from the group comprising Ni, Cr, Mo, and combinations thereof, and the balance of Fe and inevitable impurities, with respect to 100 wt % of the total steel sheet, the deviation of Rockwell hardness by the position in the width direction of the steel sheet for a tool is within 5 HRC, a steel sheet having the ratio of those having a wave height in the longitudinal direction within 20 cm is 90% or more may be provided with respect to the wave height per 1 m of the steel plate comprising the central portion in the longitudinal direction of the steel sheet for a tool.

More specifically, the ratio of those having a wave height in the longitudinal direction within 10 cm may be 90% or more with respect to the wave height per 1 m of the steel sheet comprising the central portion in longitudinal direction of the steel sheet for a tool.

the ratio of those having a wave height in the longitudinal direction within 20 cm may be 90% or more with respect to the total wave height located the central portion in the longitudinal direction of the steel sheet for a tool.

The wave height in the longitudinal direction of the steel sheet for a tool may be within 20 cm.

the wave height in the longitudinal direction of the steel sheet for a tool may be within 10 cm.

More specifically, it may be 0.1 to 1.0 wt % of Mn and 0.05 to 0.3 wt % of V. Even more specifically, at least of one or two components selected from the group consisting of Ni, Cr, Mo, and combinations thereof may be 0.5 to 2.0 wt %.

It may consist of 70% or more of bainite structure, and the balance of ferrite and pearlite mixed structure with respect to 100% of a total microstructure of the steel sheet for a tool.

More specifically, it may consist of 90% or more of bainite structure, and the balance of ferrite and pearlite mixed structure with respect to 100% of a total microstructure of the steel sheet for a tool. More specifically, the deviation of Rockwell hardness by the position in the width direction of the steel sheet for a tool may be within 3 HRC.

The Rockwell hardness of the steel sheet for a tool may be 36 to 41 HRC.

A value of the combination of the thickness and the wave height of the steel sheet for a tool (wave height×thickness$^2$) may be 2 cm$^3$ or less. The thickness of the steel sheet for a tool may be 5 mm or less.

A method for manufacturing a steel sheet for a tool according to other embodiment of the present invention, may comprise the steps of preparing a slab comprising 0.4 to 0.6 wt % of C, 0.05 to 0.5 wt % of Si, 0.1 to 1.5 wt % of Mn, 0.05 to 0.5 wt % of V, 0.1 to 2.0 wt % of at least of one or two selected from the group consisting of Ni, Cr, Mo, and combinations thereof, and the balance of Fe and inevitable impurities with respect to a total of a slab of 100 wt %; heating the slab again; performing the hot rolling the slab heated again to obtain hot-rolled steel sheet; cooling the hot-rolled steel sheet obtained; winding the cooled steel sheet to obtain a coil; and cooling the wound coil.

More specifically, the step of cooling the obtained hot-rolled steel sheet may comprise a primary cooling step of cooling the obtained hot-rolled steel sheet at a rate of 20 to 40° C./sec within 15 seconds after completion of hot rolling; and a secondary cooling step of cooling the primary cooled steel sheet at a rate of 5 to 10° C./sec within 30 seconds after the primary cooling.

The step of winding the cooled steel sheet to obtain a coil; may be carried out in a temperature range by the following formula 1 of $T_c$(° C.) or more.

$$T_c(^\circ\,C.)=880-300*C-80*Mn-15*Si-45*Ni-65*Cr-85*Mo \quad \text{[Formula 1]}$$

Mn, Ni, Cr, and Mo mean, however, weight percent of each component with respect to 100 wt % of the total slab The step of winding the cooled steel sheet to obtain a coil; may be carried out in a temperature range by the formula 1 of $T_c$(° C.) to 650° C. or less.

The step of cooling the wound coil; may be cooled at a rate of 0.005 to 0.05° C./sec.

By the step of cooling the wound coil; the austenite structure may be transformed into a bainite structure, and the coil may be a bainite uniform structure in both the inner winding and outer winding.

By the step of cooling the wound coil; steel sheet for a tool consisting of 70% or more of bainite structure, and the balance of ferrite and pearlite mixed structure with respect to 100% of a total microstructure may be provided.

In the step of preparing a slab; it may be 0.1 to 1.0 wt % of Mn, 0.05 to 0.3 wt % of V, and at least of one or two components selected from the group consisting of Ni, Cr, Mo, and combinations thereof may be 0.5 to 2.0 wt %.

By the step of performing the hot rolling the slab heated again to obtain hot-rolled steel sheet; a thickness of the hot-rolled steel sheet obtained may be 5 mm or less.

The Rockwell hardness of the steel sheet for a tool may be 36 to 41 HRC.

The deviation of Rockwell hardness by the position in the width direction of the steel sheet for a tool may be within 5 HRC. More specifically, it may be within 3 HRC.

The ratio of those having a wave height in the longitudinal direction within 20 cm may be 90% or more with respect to the total wave height located the central portion in the longitudinal direction of the steel sheet for a tool.

A value of the combination of the thickness and the wave height of the steel sheet for a tool (wave height×thickness$^2$) may be 2 cm$^3$ or less.

Advantageous Effects

An embodiment according to the present invention is intended to provide a method for manufacturing a high-carbon steel sheet for a tool having a small deviation of the structure by position and of the properties and excellent in shape to develop hot-rolled coil which is thin and has wide width.

MODE FOR INVENTION

Figure 1:
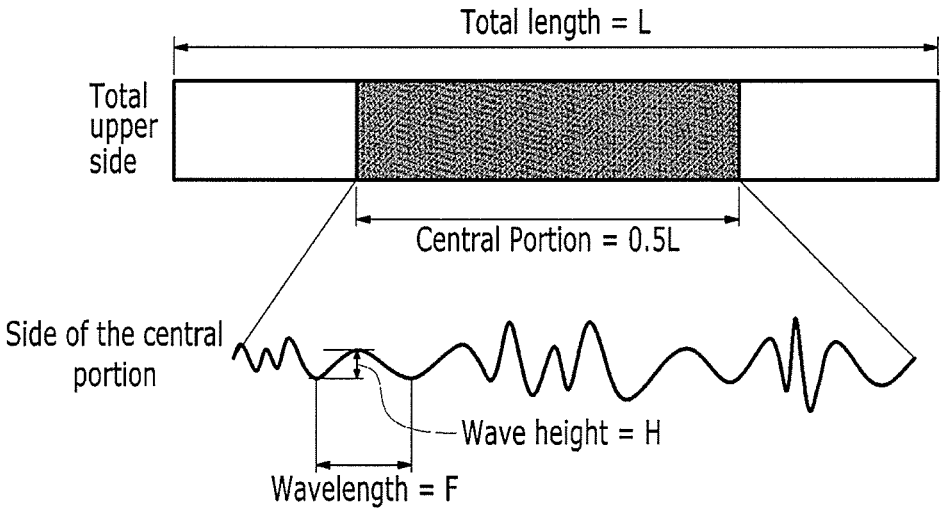
FIG. 1 is a depiction of the height of the wave height according to an embodiment of the present invention.

The advantages and features of the present invention, and the manner of achieving them will become apparent with embodiments described in detail with accompanying drawings. However, the present invention is not limited to the examples disclosed below, but may be embodied in various forms, and the examples are only provided to let the disclosure of the present invention be perfect and to be fully understood about the scope of the invention by those who are having ordinary knowledge of the technical field to which the present invention belongs, and it is defined only by the scope of the claims. Throughout the specification, the same reference mark refers to the same element.

Therefore, in some examples, well-known technology is not specifically described to avoid that the present invention is ambiguously interpreted. Unless defined otherwise, all of terms (comprising technical and scientific terms) used herein may be used in the same meaning as commonly understood by those who are having ordinary knowledge of the technical field to which the present invention belongs. When a certain part "comprises" a certain element throughout the specification, it means that the element may comprise other elements as well, not exclude the other elements, unless specifically stated otherwise. The singular forms comprise plural forms as well unless specifically mentioned otherwise.

The steel sheet for a tool according to an embodiment of the present invention may be the steel sheet comprising 0.4 to 0.6 wt % of C, 0.05 to 0.5 wt % of Si, 0.1 to 1.5 wt % of Mn, 0.05 to 0.5 wt % of V, 0.1 to 2.0 wt % of at least of one or two components selected from the group comprising Ni, Cr, Mo, and combinations thereof, and the balance of Fe and inevitable impurities.

Hereinafter, reasons for limiting the component and the composition range of the steel sheet for a tool, which is an embodiment of the present invention, will be described.

First, the carbon (C) may be 0.4 to 0.6 wt %.

Carbon is an indispensable element for improving the strength of the steel sheet, and it is necessary to appropriately add carbon to secure the strength of the high-carbon steel sheet for a tool to be embodied in the present invention. More specifically, when the content of carbon (C) is less than 0.4 wt %, the high-carbon steel sheet for a tool may not be obtained the desired strength. On the other hand, when the content of carbon (C) is greater than 0.6 wt %, the toughness of the steel sheet may be deteriorated.

The silicon (Si) may be 0.05 to 0.5 wt %.

Silicon helps to improve the strength of the steel by solid solution strengthening and deoxidate of molten steel, however, if it is added excessively, it may deteriorate the surface quality of the steel sheet by forming a scale on the surface of the steel sheet when performing hot rolling. Therefore, an embodiment of the present invention may comprise 0.05 to 0.5 wt % of silicon.

Manganese (Mn) may be comprised 0.1 to 1.5 wt %. More specifically, manganese (Mn) may be comprised 0.1 to 1.0 wt %.

Manganese (Mn) may improve the strength and hardenability of steel, and acts a role in suppressing cracks caused by sulfur (S) by combining with sulfur (S) contained inevitably during the manufacturing process of steel to form MnS. Therefore, in an embodiment of the present invention, it may be added 0.1 wt % or more to achieve the effect as above. However, if it is added excessively, the toughness of the steel may be lowered.

Vanadium (V) may be comprised 0.05 to 0.5 wt %. More specifically, it may be comprised 0.05 to 0.3 wt %.

Vanadium forms a carbide such that plays effective role in preventing coarsening of crystal grains and improving wear resistant during heat treatment. However, if it is added excessively, not only carbides are formed more than necessary to lower the toughness of the steel, but also the manufacturing cost may be increased because it is an expensive element.

In addition, at least of one or two components selected from the group comprising Ni, Cr, Mo, and combinations thereof may be comprised 0.1 to 2.0 wt %. More specifically, at least of one or two components selected from the group consisting of Ni, Cr, Mo, and combinations thereof may be 0.5 to 2.0 wt %.

Nickel (Ni), chromium (Cr) and molybdenum (Mo) act a role in improving the strength, suppressing decarburization and improving the hardenability. In addition, corrosion resistance may be improved by forming a compound on the surface. However, if it is added excessively, not only the hardenability is improved more than necessary, but also the manufacturing cost can be increased because it is an expensive element.

The balance Fe and inevitable impurities may be comprised, however, addition of an effective component other than above composition is not excluded.

Furthermore, the steel sheet for a tool according to an embodiment of the present invention that satisfies the component and the composition range may consist of 70% or more of bainite structure, and the balance of ferrite and pearlite mixed structure with respect to 100% of a total microstructure of the steel sheet.

More specifically, ferrite not comprising carbide, pearlite of a lamellar structure and a bainite structure comprising carbide are disclosed in different forms on a tissue image. Therefore, the method for measuring the fraction of microstructure, the volume fraction may be measured based on the morphology of the microstructure on the flat tissue image.

More specifically, when the bainite structure is less than 70%, with respect to 100% of a total microstructure as described above, the fraction of residual ferrite and pearlite structure become high, so that heterogeneousness of structure may be increased. Therefore, the residual stress due to the heterogeneousness of the structure, which may cause heterogeneousness in the shape of the steel sheet.

More specifically, the bainite structure may be 90% or more with respect to 100% of a total microstructure of the steel sheet for a tool as described above.

In addition, due to the bainite structure, the Rockwell hardness of the steel sheet for a tool may be 36 to 41 HRC, and the deviation of the Rockwell hardness by the position of the steel sheet for a tool may be within 5 HRC. More specifically, the deviation of the Rockwell hardness by the position of the steel sheet for a tool may be within 3 HRC. The Rockwell hardness is measured automatically by a conventional hardness tester.

More specifically, when the deviation of the Rockwell hardness by the position of the steel sheet for a tool exceeds the above range, the difference of hardness according to the position may be increased. Because of this, the residual stress may be generated, which may cause defects in the shape of the steel sheet.

Furthermore, a wave height in the longitudinal direction of the steel sheet for a tool may be within 20 cm, and more specifically, a wave height in the longitudinal direction of the steel sheet for a tool may be within 10 cm.

More specifically, the ratio of those having a wave height in the longitudinal direction within 20 cm may be 90% or more with respect to the total wave height located the central portion in the longitudinal direction of the steel sheet for a tool.

More specifically, the ratio of those having a wave height in the longitudinal direction within 20 cm may be 90% or more with respect to the wave height per 1 m of the steel sheet comprising the central portion in longitudinal direction of the steel sheet for a tool. More specifically, the ratio of those having a wave height in the longitudinal direction within 10 cm may be 90% or more with respect to the wave height per 1 m of the steel sheet comprising the central portion in longitudinal direction of the steel sheet for a tool.

More specifically, the final version of manufactured steel sheet for a tool may be wave shape at the side of the steel sheet due to a variation in hardness by position. However, the wave height in the longitudinal direction of the steel sheet for a tool according to an embodiment of the present invention may be within 20 cm. The wave height may be located in central portion in longitudinal direction of the steel sheet for a tool, more specifically, it may be a wave height per 1 m of the steel sheet comprising the central portion in longitudinal direction of the steel sheet for a tool.

In this case, the wave height means the height difference between the highest point and the lowest point in the wave position.

In addition, the central portion in longitudinal direction of the steel sheet for a tool means a portion comprising ±25% of a total length of the steel sheet on the basis of the center point.

In addition, the ratio within 20 cm of the wave height means the sum of length of the wavelengths within 20 cm with respect to the total sum of length of the total wavelength. This is also true for the ratio within 10 cm of the wave height.

The wave height, the central portion in longitudinal direction of the steel sheet for a tool and the ratio within 20 cm of the wave height are disclosed in detail in FIG. 1.

FIG. 1 is a depiction of the height of the wave height according to an embodiment of the present invention.

In addition, when the ratio of those having a wave height in the longitudinal direction within 20 cm is 90% or more, the deviation of hardness of steel sheet by the position is not large, so that the productivity may be improved in the step of subsequent process of processing the steel sheet. In particular, it may prevent the occurrence of cracks during cold rolling.

When the wave height in the longitudinal direction of the steel sheet is greater than 20 cm or is less than 90%, and when it is subsequently wound in the form of a coil, the winding shape may be defective. This may lead to defects in material during transportation and unwrapping operation.

In addition, a value of the combination of the thickness and the wave height of the steel sheet for a tool (wave height×thickness$^2$) may be 2 cm$^3$ or less. More specifically, the combined value of thickness and wave height may be 2 cm$^3$ or less since the wave height may vary depending on the thickness of the steel sheet.

More specifically, when the value of (wave height×thickness$^2$) is 2 cm$^3$ or less, it is possible to improve the defective shape due to the wave height during the subsequent process, and through this, a flat and product which has a constant size may be manufactured.

In addition, the thickness of the steel sheet for a tool according to an embodiment of the present invention satisfying the above characteristics may be 5 mm or less. At this time, the steel sheet for a tool may be hot-rolled steel sheet performed and completed hot rolling, and the thickness of the steel sheet may be the thickness of the hot-rolled steel sheet.

More specifically, when the thickness of the steel sheet for a tool exceeds 5 mm, and the reduction ratio for cold rolling is increased, so that the yield may be improved or the workability may be inferior.

On the other hand, the steel sheet for a tool according to an embodiment of the present invention has a relatively small deviation of hardness by the position, steel sheet with the thickness less than 5 mm may be provided since the shape of the steel sheet is comparatively smooth.

A method for manufacturing a steel sheet for a tool according to other embodiment of the present invention, may comprise the steps of preparing a slab comprising 0.4 to 0.6 wt % of C, 0.05 to 0.5 wt % of Si, 0.1 to 1.5 wt % of Mn, 0.05 to 0.5 wt % of V, 0.1 to 2.0 wt % of at least of one or two selected from the group consisting of Ni, Cr, Mo, and combinations thereof, and the balance of Fe and inevitable impurities with respect to a total of a slab of 100 wt %; heating the slab again; performing the hot rolling the slab heated again to obtain hot-rolled steel sheet; cooling the hot-rolled steel sheet obtained; winding the cooled steel sheet to obtain a coil; and cooling the wound coil.

First, the steps of preparing a slab comprising 0.4 to 0.6 wt % of C, 0.05 to 0.5 wt % of Si, 0.1 to 1.5 wt % of Mn, 0.05 to 1.0 wt % of Ni, 0.5 to 2.0 wt % of Cr, 0.5 to 2.0 wt % of Mo, 0.05 to 0.3 wt % of V and the balance of Fe and inevitable impurities with respect to a total of a slab of 100 wt %; may be carried out.

At this time, the Mn may be 0.1 to 1.0 wt %, the Ni may be 0.5 to 1.0 wt %, and the Cr may be 0.7 to 2.0 wt %. In addition, the Mo may be 0.5 to 1.5 wt % and the V may be 0.05 to 0.2 wt %.

The reason for limiting the composition range and the component of the slab is the same as that for limiting the component and the composition range of the steel sheet for a tool according to an embodiment of the present invention as mentioned above.

Then the step of heating the slab again; may be carried out.

More specifically, the slab may be reheated up to a temperature in the range of 1200 to 1300° C., by reheating at the temperature range above, not only it may make the heterogeneous cast structure to homogeneous structure, but also it may expect a sufficiently high temperature for hot rolling.

Thereafter, the performing the hot rolling the slab heated again to obtain hot-rolled steel sheet; may be carried out. At this time, the slab may be rolled at a temperature in the range of 900 to 1200° C.

The thickness of the hot-rolled steel sheet obtained by the above step may be 5 mm or less.

More specifically, the steel sheet for a tool according to an embodiment of the present invention does not have a large deviation of hardness by the position, therefore, hot-rolled steel sheet having a thickness of 5 mm or less may be obtained without occurring cracks. When the hot-rolled steel sheet having the thickness is obtained, the workability may be improved by reducing the yield during a subsequent process such as cold rolling.

Then the step of cooling the hot-rolled steel sheet obtained; may be carried out.

More specifically, it may comprise a primary cooling step of cooling the obtained hot-rolled steel sheet at a rate of 20 to 40° C./sec within 15 seconds after completion of hot rolling; and a secondary step of cooling the previously cooled hot-rolled steel sheet at a rate of 5 to 10 C/sec within 30 seconds after the previous cooling.

Even more specifically, by dividing the cooling steps into primary and secondary, and cooling hot-rolled steel sheet obtained from the above at different rate, the scale, which is and it may be cooled to a desired temperature.

Next, the step of winding the cooled steel sheet to obtain a coil; may be carried out. The above step may be performed in a temperature range of $T_c$(° C.) or more according to the following formula 1.

$$T_c(°\ C.)=880-300*C-80*Mn-15*Si-45*Ni-65*Cr-85*Mo \quad \text{[Formula 1]}$$

Wherein the C, Mn, Si, Ni, Cr and Mo mean the wt % of each component with respect to a total of a slab of 100 wt %.

More specifically, the step of winding the cooled steel sheet to obtain a coil; may be performed at a temperature range from $T_c$(° C.) to 650° C. by the formula 1. The reason for controlling the winding temperature as the Formula 1 is to suppress bainite transformation before winding. By controlling as described above, a homogeneous microstructure may be achieved with sufficient time after winding, resulting in manufacturing a steel sheet with satisfactory shape.

Next, the step of cooling the wound coil; may be carried out.

More specifically, the coil may be cooled at a rate of 0.005 to 0.05° C./sec. At this time, the microstructure of the coil may be transformed from the austenite structure to the bainite structure, as a result, both of the inner portion and outer portion may be a bainite homogeneous structure.

More specifically, it may consist of 70% or more of bainite structure, and the balance of ferrite and pearlite mixed structure with respect to 100% of a fraction of total microstructures of the coil. More specifically, it may consist of 90% or more of bainite structure, and the balance of ferrite and pearlite mixed structure with respect to 100% of a fraction of total microstructures of the coil.

In addition, by cooling the wound coil at the rate mentioned above, a homogeneous microstructure may be achieved.

The Rockwell hardness of the steel sheet for a tool manufactured by the method above may be 36 to 41 HRC, and the deviation of Rockwell hardness by the position of the steel sheet for a tool may be within 5 HRC. More specifically, the deviation of the Rockwell hardness by the position of the steel sheet for a tool may be within 3 HRC.

In addition, the wave height in the longitudinal direction of the steel sheet for a tool may be within 20 cm, and a value of the combination of the thickness and the wave height of the steel sheet for a tool (wave height×thickness$^2$) may be 2 cm$^3$ or less.

Hereinafter, it will be described in detail through examples. The following examples are only to illustrate the present invention and the contents of the present invention are not limited thereto.

Examples

A slab having the composition shown in Table 1 was prepared, and then the slab was reheated at 1250° C. After performing the hot rolling the slab reheated to a thickness of 3.5 mm, the hot-rolled steel sheet was cooled under the conditions shown in Table 2 below.

At this time, the primary cooling and secondary cooling are the step of cooling the hot-rolled steel sheet by water cooling or air cooling. Thereafter, the primary and secondary cooled steel sheets were wound up according to the conditions shown in Table 2 below to obtain a coil. Finally, the entire wound coil was air cooed.

More specifically, the hot-rolled steel sheet was primary cooled by water cooling within 15 seconds after the end of hot rolling. After the primary cooling, the steel sheet was secondary cooled by air cooling within 30 seconds. At this time, the cooling rate is as shown in Table 2 below.

In addition, after cooling the hot-rolled steel sheet, it was wound to obtain the coil at a temperature range of Formula 1 or more, and then wound coil was cooled at the rate disclosed in Table 2 below.

Figure 2:
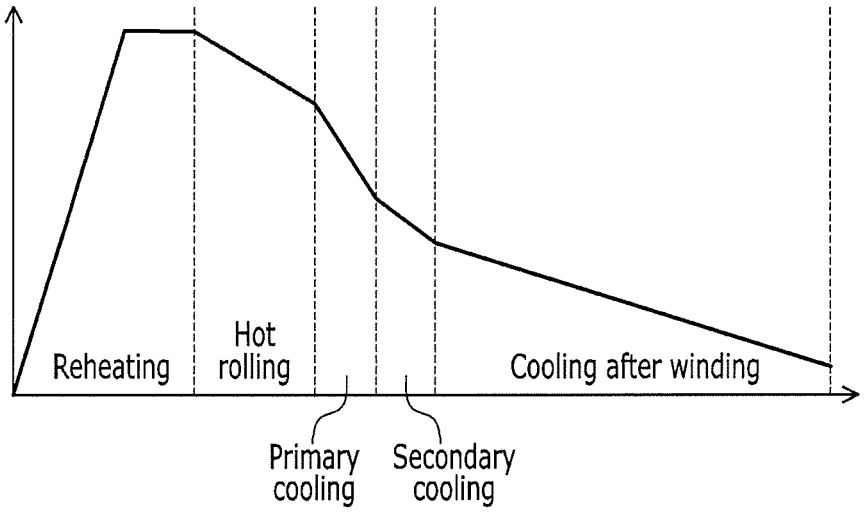
FIG. 2 is a graph showing the temperature history of steel sheet according to other embodiment of the present invention.

More specifically, FIG. 2 is a graph showing the temperature history of a steel sheet according to other embodiment of the present invention. Therefore, the rate of temperature change of the steps of reheating-hot rolling-primary cooling-secondary cooling-winding the coil may be known.

TABLE 1

| Steel specification | Thickness | C | Mn | Si | Ni | Cr | Mo | V | Formula 1 |
|---|---|---|---|---|---|---|---|---|---|
| Comparative steel 1 | 3.5 | 0.31 | 0.81 | 0.23 | 0.6 | 0.9 | 0.4 | 0.09 | 599 |
| Invented steel 1 | 3.5 | 0.47 | 0.73 | 0.19 | 0.7 | 0.8 | 1.1 | 0.07 | 501 |
| Invented steel 2 | 3.5 | 0.52 | 0.79 | 0.20 | 0.6 | 0.6 | 0.7 | 0.06 | 532 |
| Comparative steel 2 | 3.5 | 0.2 | 0.65 | 0.16 | 0.7 | 0.4 | 0.3 | 0.11 | 683 |

TABLE 2

| Steel specification | Classification | Finishing rolling temperature (° C.) | Primary cooling temperature (° C./sec) | Finishing primary cooling temperature (° C.) | Secondary cooling temperature (° C./sec) | Winding temperature (° C.) | Coil cooling temperature (° C./sec) |
|---|---|---|---|---|---|---|---|
| Comparative steel 1 | Comparative 1 | 900 | 25 | 650 | 8 | 600 | 0.015 |
| | Comparative 2 | 900 | 35 | 600 | 8 | 550 | 0.015 |
| Invented steel 1 | Example 1 | 900 | 25 | 650 | 8 | 600 | 0.015 |
| | Example 2 | 900 | 35 | 650 | 8 | 600 | 0.015 |
| | Example 3 | 900 | 35 | 600 | 8 | 550 | 0.015 |
| | Comparative 3 | 900 | 15 | 750 | 8 | 700 | 0.015 |
| | Comparative 4 | 900 | 35 | 600 | 8 | 550 | 0.1 |
| | Comparative 5 | 900 | 40 | 500 | 8 | 450 | 0.015 |
| Invented steel 2 | Example 4 | 900 | 25 | 650 | 8 | 600 | 0.015 |
| | Example 5 | 900 | 35 | 600 | 8 | 550 | 0.015 |
| | Comparative 6 | 900 | 25 | 650 | 8 | 600 | 0.001 |
| | Comparative 7 | 900 | 40 | 550 | 8 | 500 | 0.015 |
| Comparative steel 2 | Comparative 8 | 900 | 25 | 650 | 8 | 600 | 0.015 |

TABLE 3

| Classification | Transformation fraction before winding (%) | Bainite fraction (%) | Hardness (HRC) | Deviation of hardness (HRC) | Ratio of those having a wave height within 20 cm (%) | (wave height × thickness$^2$) (cm$^3$) |
|---|---|---|---|---|---|---|
| Comparative 1 | 0 | 74 | 34 | 5 | 84 | 2.64 |
| Comparative 2 | 0 | 83 | 36 | 4 | 88 | 2.3 |
| Example 1 | 0 | 91 | 38 | 2 | 97 | 0.7 |
| Example 2 | 0 | 93 | 40 | 3 | 94 | 1.0 |
| Example 3 | 0 | 95 | 41 | 3 | 95 | 1.1 |
| Comparative 3 | 0 | 77 | 34 | 7 | 81 | 2.8 |
| Comparative 4 | 0 | 81 | 43 | 6 | 88 | 2.5 |
| Comparative 5 | 9 | 71 | 46 | 6 | 84 | 2.7 |
| Example 4 | 0 | 92 | 38 | 3 | 94 | 1.2 |
| Example 5 | 0 | 93 | 39 | 2 | 98 | 0.6 |
| Comparative 6 | 0 | 68 | 36 | 5 | 89 | 2.3 |
| Comparative 7 | 7 | 83 | 44 | 6 | 79 | 2.7 |
| Comparative 8 | 13 | 88 | 32 | 9 | 71 | 3.2 |

In case of Example 1 to 5, which satisfied both the component and composition of the steel sheet for a tool according to an embodiment of the present invention and composition of the steel sheet for a tool and the manufacturing method conditions of the steel sheet for a tool according to other embodiment of the present invention, it may be known that the deviation of the structure by position and of the properties is small since the ratio of those having a wave height within 20 cm and the deviation of the hardness within 3 HRC may be 90% or more. Because of this, it may be known that, in the case of the example according to the present invention, the steel sheet with excellent in shape was manufactured.

On the other hand, in comparative example 1 and 2, it may be known that the carbon content of steel is low and the bainite formation temperature according to Formula 1 is high. Therefore, it may be known that comparative example 1 and 2 were partially transformed into bainite prior to winding, further transformed into bainite during cooling after winding, and a steel sheet having a large hardness deviation by position and the shape with large wave height was manufactured.

In addition, in comparative example 3, it shows that the wave height is large since the deviation is large, and the hardness is low since the rate of a primary cooling is low and the winding temperature is high. In addition, in Comparative example 4, it shows that the wave height is large since the cooling rate of coil is high, and the wave height is large since the deviation is large In addition, it may be known that comparative example 5 and 7 were partially transformed into bainite prior to winding since a low winding temperature, further transformed into bainite during cooling after winding, and the hardness deviation by position is large and the wave height is large.

In addition, in Comparative example 6, it shows that the hardness is low since the cooling rate of coil after winding is low, and the wave height is large since the deviation of hardness by position is large.

In addition, in Comparative example 8, it shows that the transformation started before the winding since the carbon content is low and the transformation temperature is high and rapidly proceeds. Because of this, it shows that the hardness is low and the wave height is large.

Figure 3:
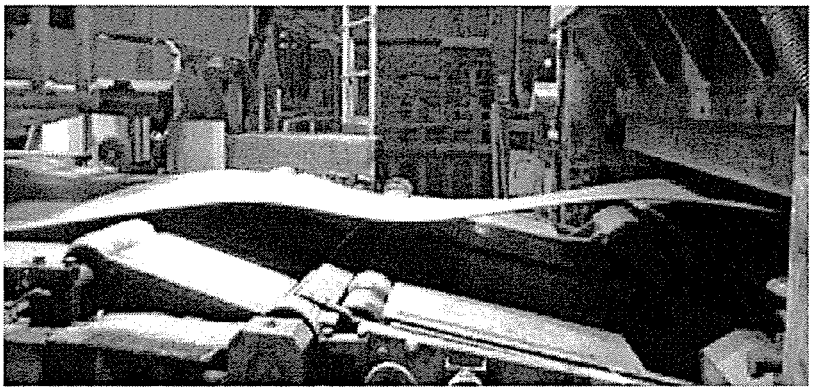
FIG. 3 shows a comparison of the shapes manufactured by the example of the present invention and the comparative example.
Figure 3:
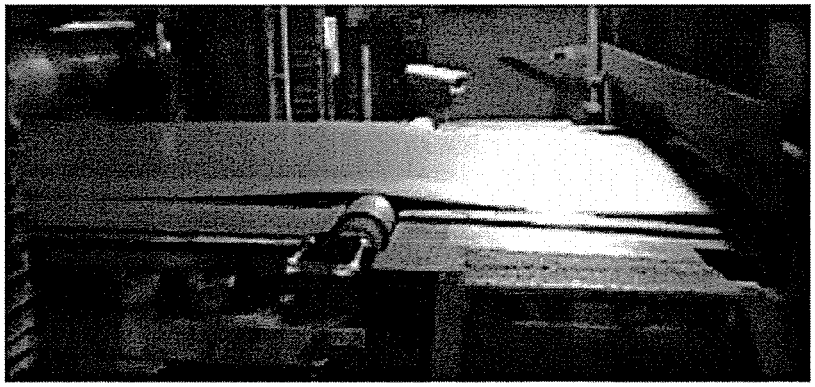

It may be confirmed by what has been disclosed in FIG. 3.

FIG. 3 shows a comparison of the shapes manufactured by the examples of the present invention and the comparative example.

More specifically, in the case of the example manufactured by an embodiment of the present invention, it may be clearly confirmed that the wave height is not larger than the wave height shown in the Comparative example.

Although the example of the present invention is described with the accompanying drawings, those who have ordinary knowledge of the technical field to which the present invention belongs may understand that it may be carried out in different and concrete forms without changing the technical idea or fundamental feature of the present invention Therefore, the examples described above are illustrative in all aspects and not limitative. The scope of the present invention is shown in claims rather than the detailed description, every modification and modified aspect derived from the meaning and the scope of the claims and equivalent concepts should be interpreted as being comprised in the scope of the present invention.

The invention claimed is:

1. A steel sheet for a tool comprising 0.4 to 0.6 wt % of C, 0.05 to 0.5 wt % of Si, 0.1 to 1.5 wt % of Mn, 0.05 to 0.5 wt % of V, at least one or two components selected from the group consisting of 0.05 to 1.0 wt % of Ni, 0.5 to 2.0 wt % of Cr, 0.5 to 2.0 wt % of Mo, and combinations thereof, and the balance of Fe and inevitable impurities, with respect to 100 wt % of the total steel sheet, wherein the steel sheet consists of 70% or more of bainite structure, and the balance of ferrite and pearlite mixed structure with respect to 100% of a total microstructure of the steel sheet, wherein the deviation of Rockwell hardness by the position in the width direction of the steel sheet for a tool is within 5 HRC, wherein the ratio of those having a wave height in the longitudinal direction within 20 cm is 90% or more with respect to the wave height per 1 m of the steel sheet located in the central portion in the longitudinal direction of the steel sheet for a tool, and wherein the Rockwell hardness of the steel sheet for a tool is 36 to 41 HRC.

2. The steel sheet for a tool of claim 1, wherein the ratio of those having a wave height in the longitudinal direction within 10 cm is 90% or more with respect to the wave height per 1 m of the steel plate located in the central portion in the longitudinal direction of the steel sheet for a tool.

3. The steel sheet for a tool of claim 1, wherein Mn: 0.1 to 1.0 wt %.

4. The steel sheet for a tool of claim 1, wherein V: 0.05 to 0.3 wt %.

5. The steel sheet for a tool of claim 1, wherein the steel sheet includes a total of 0.5 to 2.0 wt % of the at least one or two components selected from the group consisting of Ni, Cr, Mo, and combinations thereof.

6. The steel sheet for a tool of claim 1, wherein the deviation of Rockwell hardness by the position in the width direction of the steel sheet for a tool is within 3 HRC.

7. The steel sheet for a tool of claim 1, wherein a value of the combination of the thickness and the wave height of the steel sheet for a tool (wave height×thickness$^2$) is 2 cm$^3$ or less.

8. The steel sheet for a tool of claim 1, wherein the thickness of the steel sheet for a tool is 5 mm or less.

* * * * *